US007484904B2

(12) United States Patent
Guedon

(10) Patent No.: US 7,484,904 B2
(45) Date of Patent: Feb. 3, 2009

(54) RISING SECURITY BARRIER

(75) Inventor: Olivier Guedon, Aumont sur Oise (FR)

(73) Assignee: BCA Barrieres et Controle d'Acces, Chambly (FR)

( * ) Notice: Subject to any disclaimer, the term of this patent is extended or adjusted under 35 U.S.C. 154(b) by 131 days.

(21) Appl. No.: 10/581,629

(22) PCT Filed: Dec. 2, 2004

(86) PCT No.: PCT/FR2004/003095

§ 371 (c)(1),
(2), (4) Date: Jun. 2, 2006

(87) PCT Pub. No.: WO2005/056928

PCT Pub. Date: Jun. 23, 2005

(65) Prior Publication Data

US 2007/0124998 A1 Jun. 7, 2007

(30) Foreign Application Priority Data

Dec. 3, 2003 (FR) ..... 03 14188

(51) Int. Cl.
*E01F 13/00* (2006.01)
*E01F 15/00* (2006.01)
*E01F 13/04* (2006.01)
*E01F 13/06* (2006.01)

(52) U.S. Cl. ..... 404/6; 404/9

(58) Field of Classification Search ..... 404/6, 404/9; 49/9, 34, 49; 428/36.1, 36.3; 138/126, 138/130, 153
See application file for complete search history.

(56) References Cited

U.S. PATENT DOCUMENTS

| | | | | |
|---|---|---|---|---|
| 2,723,705 | A * | 11/1955 | Collins | 156/177 |
| 3,769,127 | A * | 10/1973 | Goldsworthy et al. | 156/172 |
| 4,016,679 | A * | 4/1977 | Ellefson | 49/49 |
| 4,364,200 | A * | 12/1982 | Cobb | 49/192 |
| 4,568,582 | A * | 2/1986 | Kikuzawa et al. | 428/34.5 |
| 4,897,960 | A * | 2/1990 | Barvinek et al. | 49/49 |
| 4,916,859 | A * | 4/1990 | Butler | 49/9 |
| 5,044,300 | A * | 9/1991 | Herd | 116/63 R |
| 5,122,417 | A * | 6/1992 | Murakami et al. | 428/371 |
| 5,293,716 | A * | 3/1994 | Rothschild | 49/49 |
| 5,671,563 | A * | 9/1997 | Marcum | 49/49 |
| 5,884,432 | A * | 3/1999 | DeLillo | 49/49 |
| 5,965,249 | A * | 10/1999 | Sutton et al. | 428/304.4 |
| 6,179,517 | B1 * | 1/2001 | Nelson | 404/6 |
| 6,345,930 | B1 * | 2/2002 | Mohassel | 404/9 |
| 6,360,487 | B1 * | 3/2002 | Kern et al. | 49/231 |
| 6,733,002 | B1 * | 5/2004 | de Maussion et al. | 256/13.1 |
| 7,160,409 | B2 * | 1/2007 | Reynolds et al. | 156/172 |
| 2006/0228177 | A1 * | 10/2006 | Allain et al. | 404/6 |
| 2007/0042170 | A1 * | 2/2007 | Morin | 428/292.1 |

FOREIGN PATENT DOCUMENTS

| | | |
|---|---|---|
| WO | WO 89/01544 | 2/1989 |

* cited by examiner

*Primary Examiner*—Raymond W Addie
(74) *Attorney, Agent, or Firm*—Colin L. Fairman, Esq.; Dorsey & Whitney LLP

(57) ABSTRACT

The invention relates to a removable barrier which is intended to control the passage of traffic on a travel path. The invention is characterized in that it comprises a rail (100) which is made from a composite material.

30 Claims, 1 Drawing Sheet

RISING SECURITY BARRIER

Figure 1:
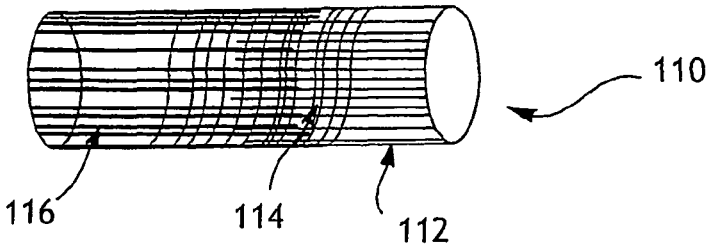

The present invention relates to the field of lifting barriers for controlling passage on a traffic lane.

The invention may find many applications.

The barriers according to the invention may in particular be used on motorway toll booths, accesses to car parks, etc.

A large number of barriers have been proposed.

Known barriers generally comprise a string rail including a metal frame, for example most often in aluminium.

Although they have been very useful, known string rails however do not always give total satisfaction.

Indeed, the following problems are frequently reported:

- deterioration of vehicles, notably breaking of windscreens, during barrier closing maneuvers,
- pedestrian injury,
- deterioration of the string rails,
- limited life-time of the mechanism for driving the barriers.

The object of the present invention is to propose a new barrier which eliminates the drawbacks of the prior art.

This object is achieved within the scope of the present invention by means of a barrier comprising a string rail in composite material.

The use of composite material for making the string rail provides many advantages.

Firstly, it allows a lightweight string rail to be made. And consequently, the lifetime of the driving mechanisms may be extended and risks of pedestrian injury and/or deterioration of vehicles may be limited.

According to other advantageous features of the present invention:

- the central tube is made on a basis of 55 to 65% by weight of yarns of glass fibers, 45 to 35% by weight of yarns of carbon fibers and resin, for example epoxy resin.
- the central tube (110) consists of:
- an internal layer formed with fiber yarns, said yarns being positioned longitudinally and parallel to each other,
- a central layer formed with fiber yarns angularly orientated as a helix relatively to the longitudinal axis of the tube,
- an external layer formed with fiber yarns, said yarns being positioned longitudinally and parallel to each other, said internal, central and external layers being obtained simultaneously and polymerized together in an epoxy resin in order to form a single-piece composite tube.
- the central tube is covered with a protective sleeve,
- the protective sleeve is made in expanded polystyrene,
- the protective sleeve is formed with two symmetrical half-shells, the median joining plane of which corresponds to a diametrical plane of the tube,
- the sleeve is covered with a sheath which has the function of maintaining in place the elements which make up this sleeve, even in the case of deterioration of the latter,
- an external cover covers the whole of the elements making up the string rail,
- the string rail is borne by a stirrup rotatably mounted around a horizontal axis on a post,
- the string rail is rotatably mounted around a vertical axis on the stirrup,
- the string rail is supported by the stirrup, by means of a clamping system.

Figure 2:
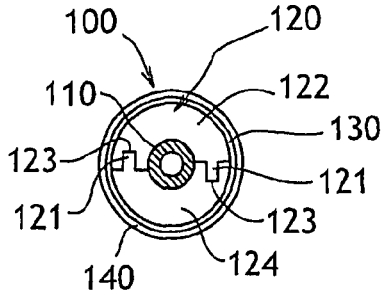
Figure 3:
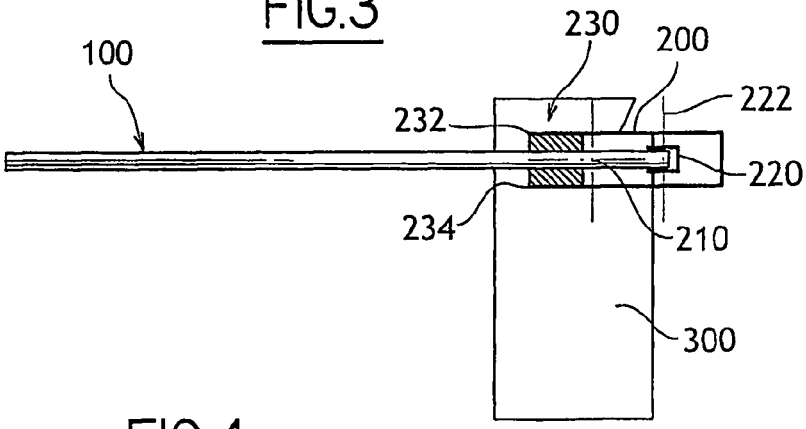
Figure 4:
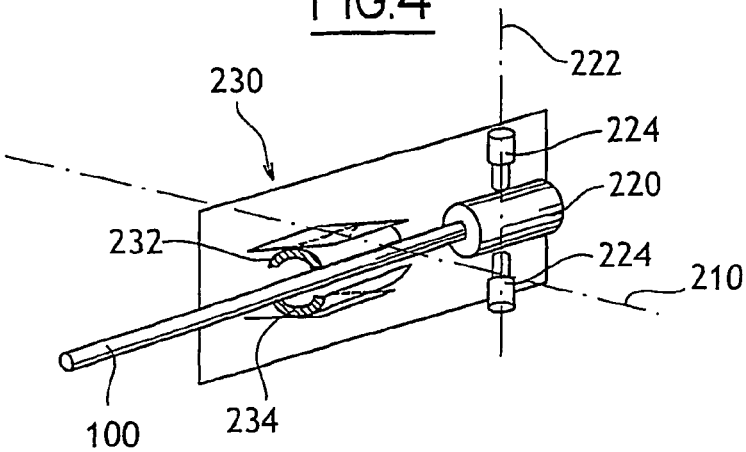

Other features, objects and advantages of the present invention will become apparent upon reading the detailed description which follows and with reference to the appended drawings given as non-limiting examples and wherein:

FIG. 1 illustrates a schematic longitudinal sectional view of the central tube of a safety barrier string rail according to the present invention, FIG. 2 illustrates a schematic transverse sectional view of the same string rail, FIG. 3 illustrates a schematic side view of a safety barrier according to the present invention, and FIG. 4 illustrates a partial view of the safety barrier according to the present invention.

A safety barrier according to the present invention comprising a bar or string rail 100, horizontal in the rest position, borne by a stirrup 200 rotatably mounted around a horizontal axis 210 on a post 300, are illustrated in the appended figures. The stirrup 200 is driven into rotation around the axis 210 by a motor housed in the post 300.

Thus, in the rest position, the string rail 100 extends horizontally through a passage to be controlled, to prevent free passage. On the contrary, after activating the motor, the string rail is pivoted vertically upwards to clear the aforementioned passage.

Within the scope of the present invention, the string rail 100 consists of a rectilinear central tube 110 with a circular cross-section, in composite material, for example based on glass fibers, carbon fibers and epoxy resin.

After many tests, the inventors retained a tube structure 110 formed by a set of carbon fiber and glass fiber yarns, coated with polymerized epoxy resin in order have the fibers adhere parallel to each other and thereby form the tube.

Making the tube 110 formed with an internal layer 112 of longitudinal and joined glass fiber yarns with a linear weight between 60 and 70 g/ml, preferably 67 g/ml, covered with a glass fiber helix 114 orientated at an angle between 60 and 80°, preferably of the order of 75° relatively to the longitudinal axis, with a linear weight between 50 and 60 g/ml, preferably 52 g/ml, itself covered with an external layer 116 of longitudinal and joined carbon fiber yarns with a linear weight between 85 and 95 g/ml, preferably 90 g/ml, provide better elasticity and a string rail may be obtained with larger flexure, more tolerant in the case of impact, both for its own lifetime and on the lowest risk as regards vehicles impacting the string rail.

Even more specifically, after many tests, the inventors retained a solution combining 55 to 65%, typically 57% of glass fibers, and 45 to 35%, typically 43% of carbon fibers for making the tube 110.

This combination of glass fiber yarns on the internal 112 and central 114 layers, with carbon fibers on the external layer 116, forming a helix sandwiched between two layers of longitudinal yarns, combined with different linear weights for the different layers, has shown better compromise in terms of strength, lifetime and damages produced in the case of impacts, than with solutions comprising 100% of carbon fibers or 100% of glass fibers.

Thus, crash tests have shown that the string rail according to the invention is capable of flexing by ±45° relatively to its longitudinal axis during impacts with a car launched at 60 km/h and by ±55° at 80 km/h.

For its making, the tube 110 is made by simultaneous pultrusion of longitudinal joined yarns of glass fibers, drawn longitudinally by means of a first die whereas a second rotating die with a larger diameter helically draws a central layer of joined yarns of glass fibers and a third die with an even larger diameter longitudinally draws joined yarns of carbon fibers.

Each of the fibers is initially covered with epoxy resin, the latter being polymerized when the tube formed with its three layers is made, so that the whole of the layers forms a complete single-piece.

The composite material tube 110 is covered with a protective sleeve, for example in expanded polystyrene 120. This sleeve has the main function of preventing damage to vehicles during impacts and protecting the composite tube 110 against all asperities which the string rail may encounter during impacts, (for example roof bars, low wall, etc. . . . ).

Preferably this sleeve 120 is formed with two symmetrical half-shells 122, 124, the median joining plane of which corresponds to a diametrical plane of the tube 110, i.e., a plane passing through the longitudinal axis of the tube 110. Both shells 122, 124 are identical. Each half-shell 122, 124 has a cross-section corresponding to a half-crown. The sleeve 120 preferably extends over almost the whole of the length of the tube 110.

More specifically, as seen in the appended FIGS. 1 and 2, preferably both half-shells 122 and 124 are longitudinally ribbed. Thus, both half-shells 122 and 124 each have, at their joining plane, on one side of the longitudinal axis, a protruding rib 121 and on the other side of the longitudinal axis, a hollow groove 123, with a cross-section complementary to the aforementioned rib 121, capable of receiving the rib facing the other half-shell.

The use of ribbed half-shells 122, 124 enables the hold of the sleeve 120 on the tube 110 to be strengthened, including when undergoing deformations upon occurrence of impacts.

The sleeve may be held on the central tube 110 by any appropriate means, for example by bonding, advantageously by means of a silicone adhesive.

Preferably, the sleeve 120 is itself covered with a sheath 130 which has the function of holding the elements in place which make up the polystyrene sleeve 120, even in the case of deterioration of the latter. The sheath 130 is advantageously formed with a heat-shrinkable polyethylene (PE) sheath.

Moreover, an external cover 140 preferably covers the aforementioned assembly to ensure its protection with regards to impacts and to contribute to visibility. This cover may consist of PVC-coated polyester fabric. To ensure visibility, the cover 140 preferably has on its external surface, contrasted or alternating color strips, advantageously at least partially reflecting strips. As a non-limiting example, for this purpose, the red color external surface of the cover 140 may be covered with a series (5 for example) of retroreflective white strips with a width of 50 mm distributed over the length of the string rail.

Preferably, the cover 140 is made in two portions in order to allow it to be easily replaced without dismantling the string rail.

As a non-limiting example;

- the tube 110 has an internal diameter of the order of 35 mm, and an external diameter of the order of 38 mm, and a length of the order of 3,400 mm,
- the internal diameter of the half-shells 122, 124 is substantially equal to the external diameter of the tube 110 so that the half-shells 122, 124 closely conform to the external surface of the tube 110,
- the external diameter of the sleeve 120 is of the order of 100 mm,
- the external diameter of the sleeve is of the order of 100 mm, so that the thickness of the sleeve 120 is larger than 50 mm, typically of the order of 60 mm,
- the specific gravity of the expanded polystyrene used for making the sleeve 120 is of the order of 20 kg/m$^3$,
- the sheath 130 is advantageously formed with a heat-shrinkable polyethylene (pE) sheath with a thickness of 120 μm,
- the cover 140 consists of 520 g/m$^2$ PVC-coated polyester fabric and with a thickness of 0.6 mm,
- the linear weight by meter of the whole of the string rail is less than 800 g/m,
- the external diameter of the string rail is larger than 90 mm, typically of the order of 100 mm.

The safety string rail proposed within the scope of the present invention provides many advantages with respect to the known means from the state of the art.

The inventors have determined experimentally that the use of a core consisting of a composite material tube 110 enables notable deformation to be tolerated in the case of an impact without causing any deterioration of the string rail, or any significant adverse effect on the element generating the impact.

More specifically, the previously described string rail which has a total weight of the order of 2,300 g and a linear weight by meter of the order 766 g, has a resistance to vehicle impacts up to 80 km/h and does not produce any breaking of windscreen of a vehicle up to 60 km/h.

Moreover, the low inertia of the string rail according to the present invention, because of its low mass, combined with its structure, strongly limits the risks of injuring or knocking out a pedestrian attempting to cross the passage during maneuvering of the barrier (it is recalled here that maneuvering of the known barriers is generally performed in less than one second, and that many accidents are reported to the operating personnel, to the police or to users, with the known prior barriers).

By using a string rail with a substantial external diameter (typically of the order of 100 mm) it is possible to improve its visibility and already limits per se the risk of impact, notably by a pedestrian.

By using a string rail having a linear weight less than 800 g/m it is possible to increase the lifetime of the driving mechanisms relatively to the lay-outs from the state of the art.

The present invention may affect all the fields of application of lifting safety barriers, notably but in a non-limiting way, the field of automatic motorway toll booths and car park toll booths.

As mentioned earlier, the string rail 100 is borne by a stirrup 200 rotatably mounted around a horizontal axis 210 on a post 300.

Even more specifically, as is seen in the appended FIGS. 3 and 4, the end of the string rail 100, adjacent to the stirrup 200 is engaged into a sleeve 220 which itself is rotatably mounted around a vertical axis 222, by hinges 224 or any equivalent means, on the stirrup 200. Moreover, the string rail 100 is supported by the stirrup 200, at a distance from the hinges 224, by a clamping system 230. The latter is preferably formed with two elastic blocks 232, 234 as shoes, positioned below and above the string rail 100, respectively.

During normal operation, when the stirrup 200 is caused to rotate around the horizontal axis 210, the string rail 100 accompanies the movement of the stirrup 200 while being held on the latter by the clamp 230.

On the other hand, when an impact is applied on the string rail 100, in a first phase, the latter may deform by the intrinsic elasticity of the tube 110. And if the force applied to the string rail 100, under the effect of the impact, exceeds the tightening force exerted by the clamp 230, the string rail 100 may move out of the clamp 230, by pivoting horizontally by rotation around the vertical axis 222. Thus, flexure of the string rail is limited and never exceeds the global flexure strength of the latter, which increases the lifetime of the device.

Once the element applying the impact on the string rail 100 is removed, the string rail may be put back into place in the clamp. The safety barrier is then again functional.

Of course, the present invention is not limited to the particular embodiments which have just been described, but extends to all alternatives in accordance with its spirit.

In particular, one skilled in the art may replace the clamp 230 with any equivalent means with which the string rail 100 may be held integral with the stirrup 200 to the extent that the applied impact force on the string rail 100 remains below a threshold, while allowing the string rail 100 to pivot horizontally relatively to the stirrup 200 when this force exceeds a threshold.

The invention claimed is:

1. A lifting barrier for controlling the passage on a traffic lane, characterized by the fact that said barrier comprises a string rail (100) in composite material, wherein said spring rail (100) comprises a rectilinear central tube (110) with a circular cross-section, in composite material, said central tube (110) being made on the basis of 55 to 65% by weight of yarns of glass fibers, 45 to 35% by weight of yarns of carbon fibers and resin, the linear weight by meter of the whole of the string rail being less than 800 g/m.

2. The barrier according to claim 1, characterized by the fact that the resin is an epoxy resin.

3. The barrier according to claim 1, characterized by the fact that it comprises a central tube (110) which consists of:

an internal layer (112) formed with yarns of glass fibers, said yarns being positioned longitudinally and parallel to each other, a central layer (114) formed with yarns of glass fibers, angularly orientated as a helix relatively to the longitudinal axis of the tube, an external layer (116) formed with yarns of carbon fibers, said yarns being positioned longitudinally and parallel to each other, said internal (112), central (114) and external (116) layers being obtained simultaneously and polymerized together in an epoxy resin so as to form a single-piece composite tube.

4. The barrier according to claim 3, characterized in that the internal layer (112) of the central tube (110) is formed with glass fiber yarns with a linear weight between 60 and 70 g/ml.

5. The barrier according to claim 3, characterized in that the central layer (114) of the tube is formed with glass fiber yarns with a linear weight between 50 and 60 g/ml.

6. The barrier according to claim 3, characterized in that the external layer (116) of the tube is formed with carbon fiber yarns with a linear weight between 85 and 95 g/ml.

7. The barrier according to claim 3, characterized in that the central layer (114) forms a helix, the tangent of which is orientated by an angle between 60 and 80° relatively to the longitudinal axis of the tube.

8. The barrier according to claim 3, characterized in that the central layer forms a helix, the tangent of which is orientated by an angle of 75° relatively to the longitudinal axis of the tube.

9. The barrier according to claim 1, characterized by the fact that it comprises a central tube (110) covered with a protected sleeve (120).

10. The barrier according to claim 9, characterized by the fact that the protective sleeve (120) is made in expanded polystyrene.

11. The barrier according to claim 9, characterized by the fact that the protective sleeve (120) is formed with two symmetrical half-shells (122, 124), the median joining plane of which corresponds to a diametrical plane of the tube (110).

12. The barrier according to claim 11, characterized by the fact that both half-shells (122, 124) are longitudinally ribbed in a complementary manner.

13. The barrier according to claim 9, characterized by the fact that the sleeve (120) is held on the central tube (110) by bonding.

14. The barrier according to claim 9, characterized by the fact that sleeve (120) is covered with a sheath (130) having the function of holding the elements in place which make up the sleeve (120), even in the case of deterioration of the latter.

15. The barrier according to claim 14, characterized by the fact that the sheath (130) is formed with heat-shrinkable polyethylene (PE).

16. The barrier according to claim 1, characterized by the fact that an external cover (140) covers the whole of the elements (110, 120, 130) making up the string rail (100).

17. The barrier according to claim 16, characterized by the fact that the cover (140) consists of PVC-coated polyester fabric.

18. The barrier according to claim 1, characterized by the fact that the external surface of the string rail (100) has strips with contrasted or alternating colors.

19. The barrier according to claim 9, characterized by the fact that the external diameter of the sleeve (120) is of the order of 100 mm.

20. The barrier according to claim 9, characterized by the fact that the thickness of the sleeve (120) is larger than 50 mm.

21. The barrier according to claim 1, characterized by the fact that the string rail (100) is borne by a stirrup (200) rotatably mounted around a horizontal axis (210) on a post (300).

22. The barrier according to claim 21, characterized by the fact that the string rail (100) is rotatably mounted around a vertical axis (222), on the stirrup (200).

23. The barrier according to claim 21, characterized by the fact that the string rail (100) is supported by the stirrup (200), by a clamping system (230).

24. The barrier according to claim 23, characterized by the fact that the clamping system is formed with two elastic blocks (232, 234), as shoes, positioned below and above the string rail (100), respectively.

25. The barrier according to claim 3, characterized in that the internal layer (112) of the central tube (110) is formed with glass fiber yarns with a linear weight of 67 g/ml.

26. The barrier according to claim 3, characterized in that the central layer (114) of the tube is formed with glass fiber yarns with a linear weight of 52 g/ml.

27. The barrier according to claim 3, characterized in that the external layer (116) of the tube is formed with carbon fiber yarns with a linear weight of 90 g/ml.

28. The barrier according to claim 9, characterized by the fact that the sleeve (120) is held on the central tube (110) by a silicone adhesive.

29. The barrier according to claim 1, characterized by the fact that the external surface of the string rail (100) at least partly reflective strips.

30. The barrier according to claim 9, characterized by the fact that the thickness of the sleeve (120) is of the order of 60 mm.

* * * * *